US008464782B2

(12) United States Patent
Samuelson et al.

(10) Patent No.: US 8,464,782 B2
(45) Date of Patent: Jun. 18, 2013

(54) MANIFOLD FLUID COMMUNICATION PLATE

(75) Inventors: David E. Samuelson, Wheatfield, NY (US); David M. Smith, Clarence Center, NY (US); Don C. Corser, Lockport, NY (US); Richard V. Cooper, Jr., Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 815 days.

(21) Appl. No.: 12/582,069

(22) Filed: Oct. 20, 2009

(65) Prior Publication Data

US 2011/0088885 A1 Apr. 21, 2011

(51) Int. Cl.

| | |
|---|---|
| ***F28F 9/04*** | (2006.01) |
| ***F28D 7/06*** | (2006.01) |
| ***F28D 1/02*** | (2006.01) |

(52) U.S. Cl.

USPC ..... 165/178; 165/176; 165/174; 165/153; 165/152; 29/890.038

(58) Field of Classification Search

USPC ..... 165/132, 148, 151, 153, 171–178, 165/910, 916, 79, 152; 285/188; 29/890.03, 29/890.038, 890.052, 890.07

See application file for complete search history.

(56) References Cited

U.S. PATENT DOCUMENTS

| | | | | |
|---|---|---|---|---|
| 1,852,363 | A * | 4/1932 | Parent | 165/162 |
| 3,589,438 | A * | 6/1971 | Boorman et al. | 165/109.1 |
| 4,213,640 | A * | 7/1980 | Miles | 285/124.2 |
| 4,285,335 | A * | 8/1981 | Simmons et al. | 126/660 |
| 4,709,689 | A * | 12/1987 | Simcox | 126/665 |
| 6,116,048 | A | 9/2000 | Hebert | |
| 6,964,296 | B2 | 11/2005 | Memory et al. | |
| 7,121,326 | B2 * | 10/2006 | Lee et al. | 165/80.3 |
| 7,188,864 | B2 * | 3/2007 | Einsiedel | 280/740 |
| 7,303,003 | B2 * | 12/2007 | Ohhashi et al. | 165/149 |
| 7,398,820 | B2 | 7/2008 | Inaba | |
| 2002/0066553 | A1 | 6/2002 | Fischer et al. | |
| 2003/0066633 | A1 * | 4/2003 | Lee et al. | 165/144 |
| 2005/0247443 | A1 * | 11/2005 | Kim | 165/176 |
| 2007/0163766 | A1 | 7/2007 | Fischer et al. | |
| 2007/0193731 | A1 * | 8/2007 | Lamich et al. | 165/149 |
| 2008/0296003 | A1 | 12/2008 | Higashiyama | |
| 2010/0270012 | A1 * | 10/2010 | Hur et al. | 165/173 |

FOREIGN PATENT DOCUMENTS

WO WO 2008038948 A1 * 4/2008

* cited by examiner

*Primary Examiner* — Frantz Jules
*Assistant Examiner* — Joseph Trpisovsky
(74) *Attorney, Agent, or Firm* — James M. Chan

(57) ABSTRACT

A communication plate extends along and is sandwiched between cylindrical communication manifolds of a first heat exchanger assembly and a second heat exchanger assembly. The communication plate includes a saddling surface arcuate in one direction and a saddling surface arcuate in the opposite direction for engaging in saddle-like fashion the cylindrical shape of the manifolds. The communication plate defines a plurality of communication plate orifices disposed along the communication plate and aligned co-axial with a plurality of communication orifices disposed along the manifolds to seal the communication orifices of the manifolds and establish distributed and sealed fluid communication between the heat exchanger assemblies.

2 Claims, 7 Drawing Sheets

MANIFOLD FLUID COMMUNICATION PLATE

BACKGROUND OF THE INVENTION

1. Field of the Invention

The subject invention relates to a heat exchanger assembly including a first heat exchanger and a second heat exchanger disposed in parallel relationship to one another for greater heat transfer capacity.

2. Description of the Prior Art

The heat exchanger assemblies to which the subject invention pertains are systems which include overlapping or double flows of working fluid to improve performance while minimizing space requirements. The design and manufacture of such a heat exchanger normally includes parallel communication manifolds which are of a round cross sectional shape to optimally contain the pressures normally occurring in such systems. Such cylindrical manifolds require a means of fluid communication between the side by side and parallel communication manifolds to attain the overlapping or double flow of working fluid in the heat exchanger assembly.

One such heat exchanger assembly is disclosed in U.S. Patent Application 2007/0193731 to Lamich, et al, wherein the heat exchanger assembly includes a first heat exchanger assembly and a second heat exchanger assembly disposed in parallel and sandwiched relationship. The first heat exchanger assembly includes a cylindrical communication manifold disposed parallel and adjacent to a cylindrical communication manifold of the second heat exchanger assembly. A flow connection is disposed between the two manifolds at adjacent the bottom ends of the communication manifolds and defines one fluid passage to establish fluid communication from the first heat exchanger assembly to the second heat exchanger assembly. However, the flow connection only at one end of the communication manifolds does not provide the distribution of coolant along and between the entire length of the communication manifolds.

Another heat exchanger assembly is disclosed in U.S. Patent Application 2002/0066553 to Fischer, et al, wherein the communication manifolds of the first and second heat exchanger assemblies define a plurality of communication orifices disposed linearly along the manifolds and wherein the communication orifices of the communication manifold of the first heat exchanger assembly are coaxial with the communication orifices of the communication manifold of the second heat exchanger assembly. This heat exchanger assembly establishes the communication manifolds disposed flush to one another. As a result, the communication manifolds are planar at the point of fluid communication which requires tight manufacturing tolerances to establish fluid communication between the first and second heat exchanger assemblies.

Additionally, it is common in a double flow heat exchanger, with cylindrical manifolds, to utilize a series of U-shaped return tubes disposed along the bottoms of the two parallel communication manifolds to establish fluid communication between the two heat exchanger assemblies. However, this arrangement requires the utilization of numerous individual return tubes which increases the manufacturing time, labor and costs. Each of the U-shaped return tubes must be handled individually and each return tube requires two braze joints to fixture the return tube to the communication manifolds. Additionally, since the return tubes are disposed along the bottom of the communication manifolds, the use of such return tubes increases the overall height of the heat exchanger assembly.

Alternatively, in place of a series of tubes, it is common to utilize a single U-shaped return tube which extends from and is brazed to the ends of the communication manifolds to establish fluid communication between the two heat exchanger assemblies. However, like the previously disclosed heat exchanger assembly, the disposition of the return tube only at one end of the communication manifolds does not provide the distribution of coolant along and between the entire length of the communication manifolds.

Although the prior art heat exchangers are able to communicate a working fluid from a first heat exchanger assembly to a second heat exchanger assembly, there remains a need for a communication design for optimizing fluid communication between a first and second heat exchanger assembly while reducing time, labor and cost during the manufacturing process.

SUMMARY OF THE INVENTION

The invention provides for a communication plate extending along and sandwiched between the manifolds of the first and second heat exchanger assemblies. The communication plate defines a plurality of communication plate orifices disposed linearly along the communication plate and aligned co-axially with the communication orifices of the manifolds to establish distributed and sealed fluid communication between the first heat exchanger assembly and the second heat exchanger assembly.

One advantage of the invention is that the communication plate can be produced as a stamped, extruded, or machined part, and thus results in cheaper manufacturing costs when compared to a series of U-shaped tubes which must be procured and handled individually. In addition, the sandwiched design of the communication plate improves the manufacturing and fabrication process and unlike the series of return tubes does not substantially increase the overall height of the multi-sectional heat exchanger assembly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE EXEMPLARY EMBODIMENTS

Figure 1:
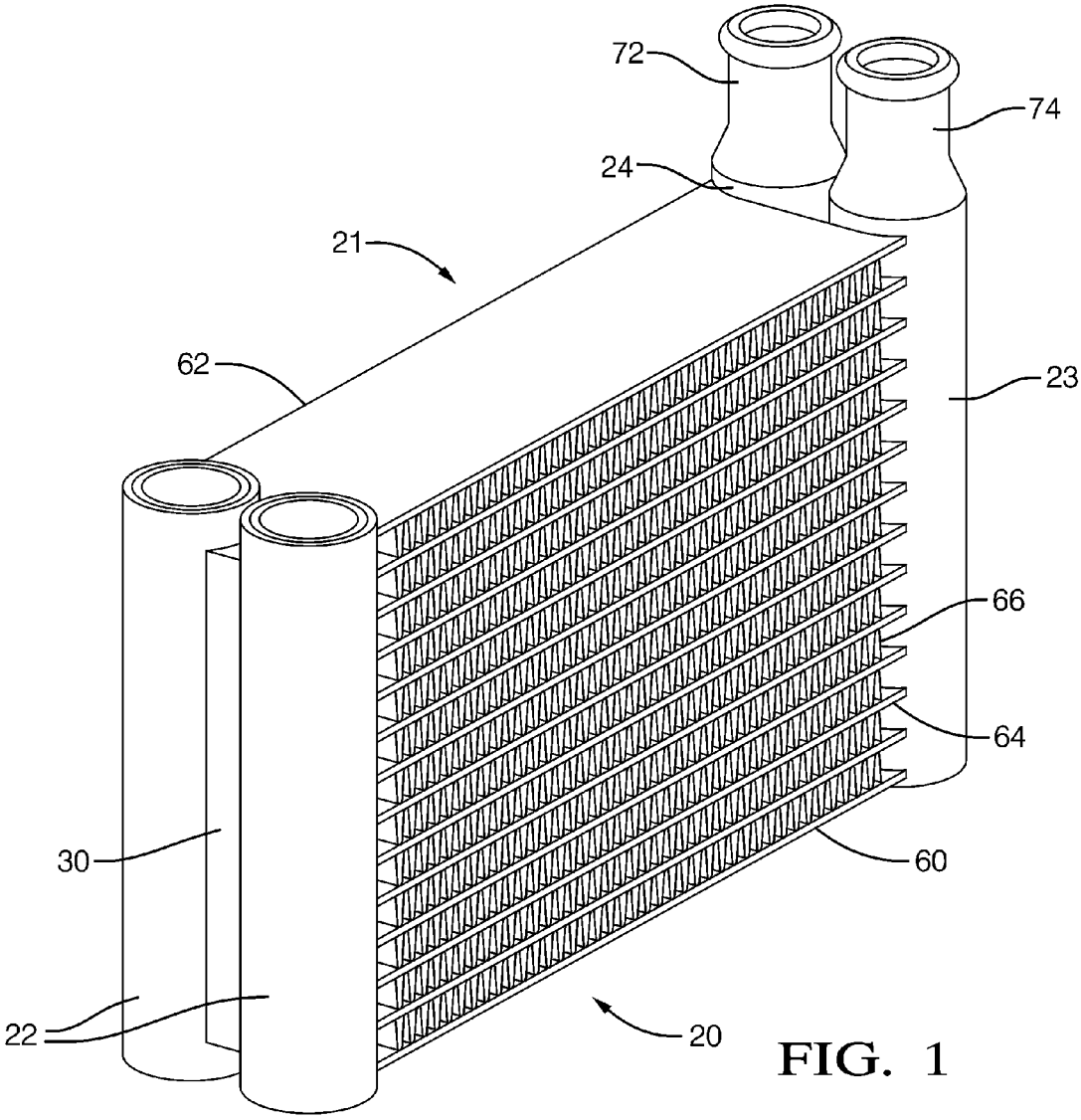
FIG. 1 is a perspective view of the heat exchanger assembly including the first embodiment of the communication plate.
Figure 2:
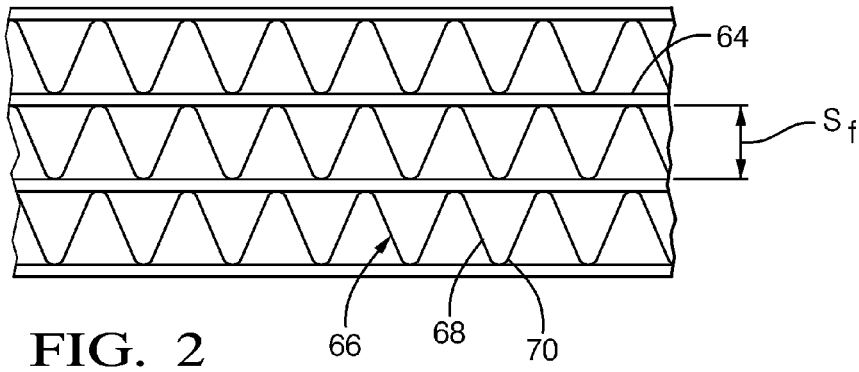
FIG. 2 is a magnified view of the heat exchanger core.
Figure 3:
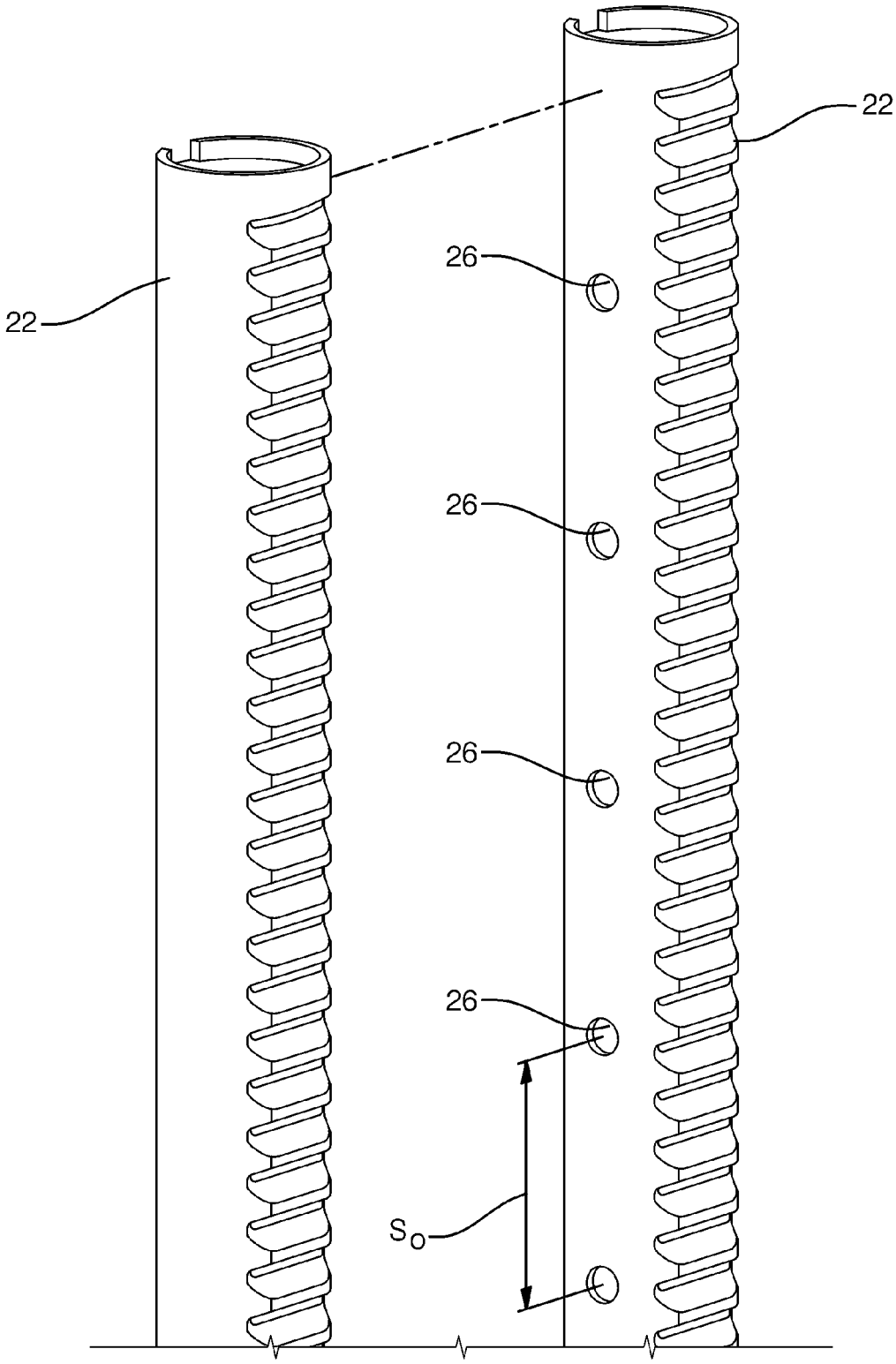
FIG. 3 is a perspective view of the communication manifolds separated from each other.
Figure 4:
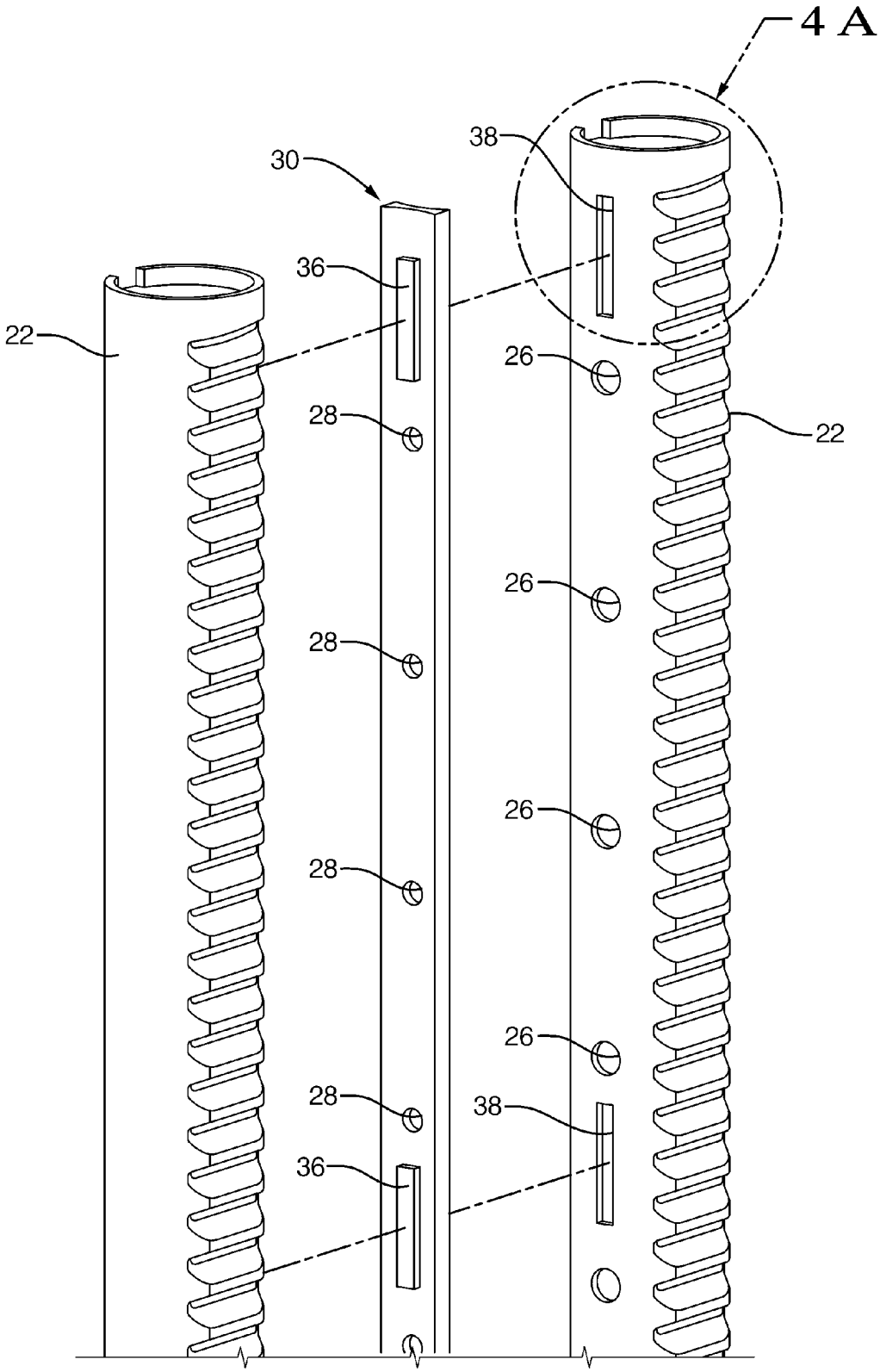
FIG. 4 is a perspective view of the communication manifolds and the first embodiment of the communication plate separated from each other.
Figure 4A:
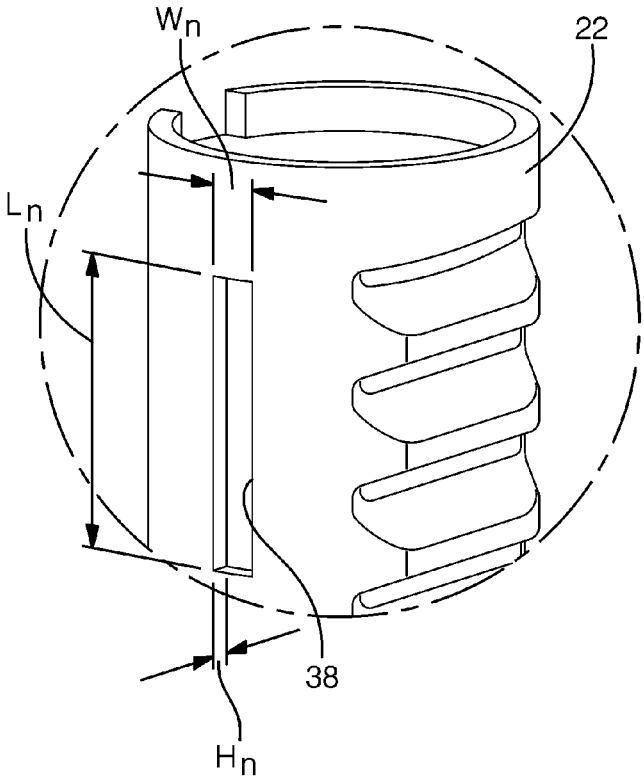
FIG. 4A is a magnified view of a portion of FIG. 4 illustrating the female notch.
Figure 6:
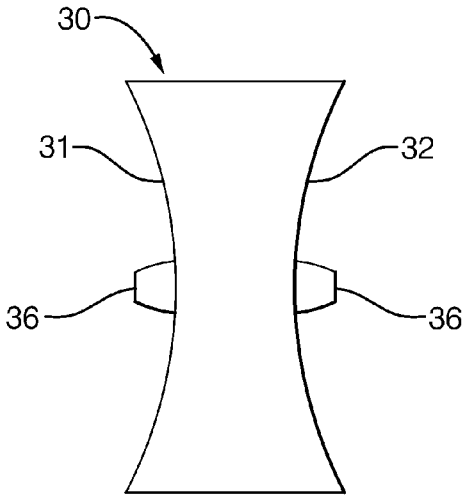
FIG. 6 is a side view of the first embodiment of the communication plate illustrating the first set of saddling surfaces extending continuously along opposite sides of the communication plate.
Figure 5:
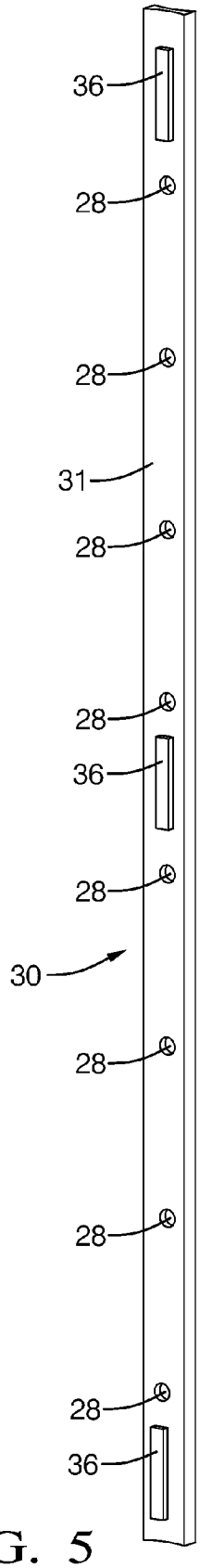
FIG. 5 is a perspective view of the first embodiment of the communication plate.

Referring to the Figures, wherein like numerals indicate corresponding parts throughout the several views, the invention comprises a multi-sectional heat exchanger assembly including a first heat exchanger assembly 20 generally shown and parallel to a second heat exchanger assembly 21 generally shown for receiving a flow of air in a transverse direction to transfer heat between the flow of air and a working fluid in the multi-sectional heat exchanger assembly. The first and second heat exchanger assemblies 20, 21 each include at least one communication manifold 22 which is cylindrical and is disposed parallel and adjacent to a corresponding cylindrical communication manifold 22 of the other heat exchanger assembly.

The preferred arrangement of the multi-sectional heat exchanger assembly includes the first heat exchanger assembly 20 and the second heat exchanger assembly 21 disposed in parallel and sandwiched relationship with the first heat exchanger assembly 20 for receiving the flow of air in a transverse direction successively through the first heat exchanger assembly 20 and the second heat exchanger assembly 21. The communication manifolds 22 of the first and second heat exchanger assemblies 20, 21 define a plurality of communication orifices 26 disposed linearly along the manifolds 22 such that the communication orifices 26 of the communication manifold 22 of the first heat exchanger assembly 20 are co-axial with the communication orifices 26 of the communication manifold 22 of the second heat exchanger assembly 21.

Figures 7, 8, 9:
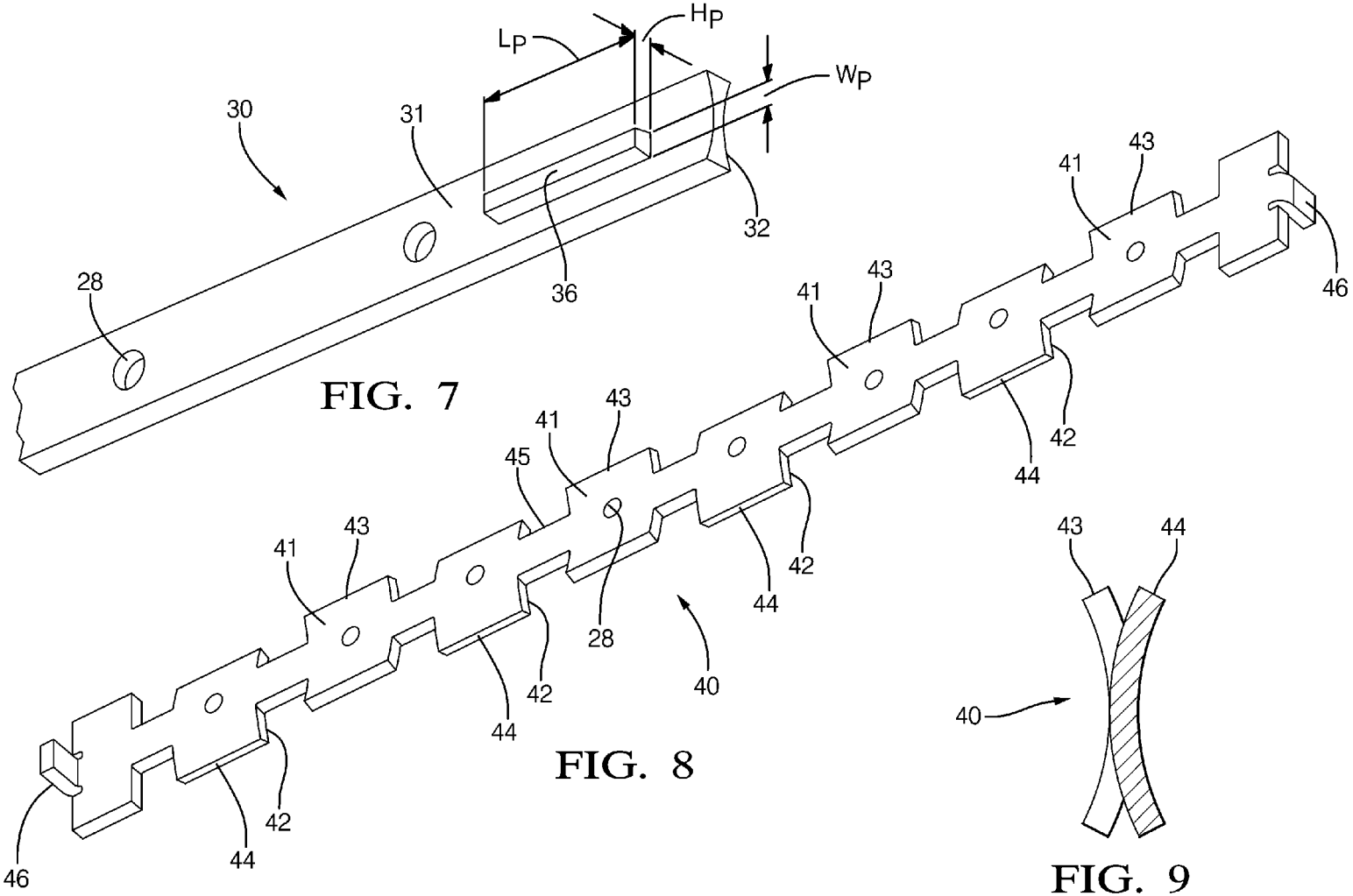
FIG. 7 is a magnified view of a portion of FIG. 5 illustrating the at least one male protrusion.
FIG. 8 is a perspective view of the second embodiment of the communication plate.
FIG. 9 is a cross-sectional side view of the second embodiment of the communication plate.
Figure 10:
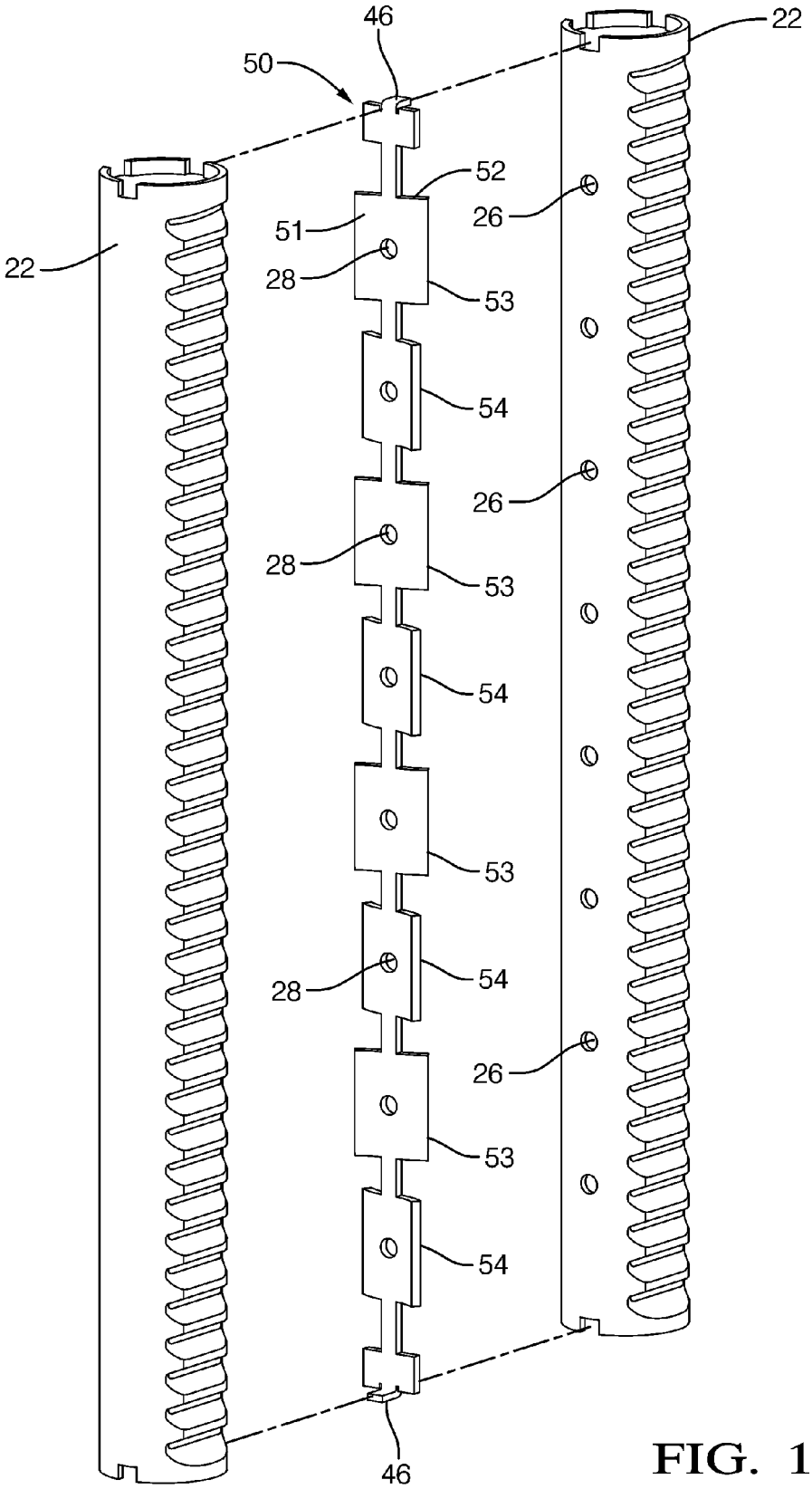
FIG. 10 is a perspective view of the communication manifolds and the third embodiment of the communication plate separated from each other.
Figures 11, 12:
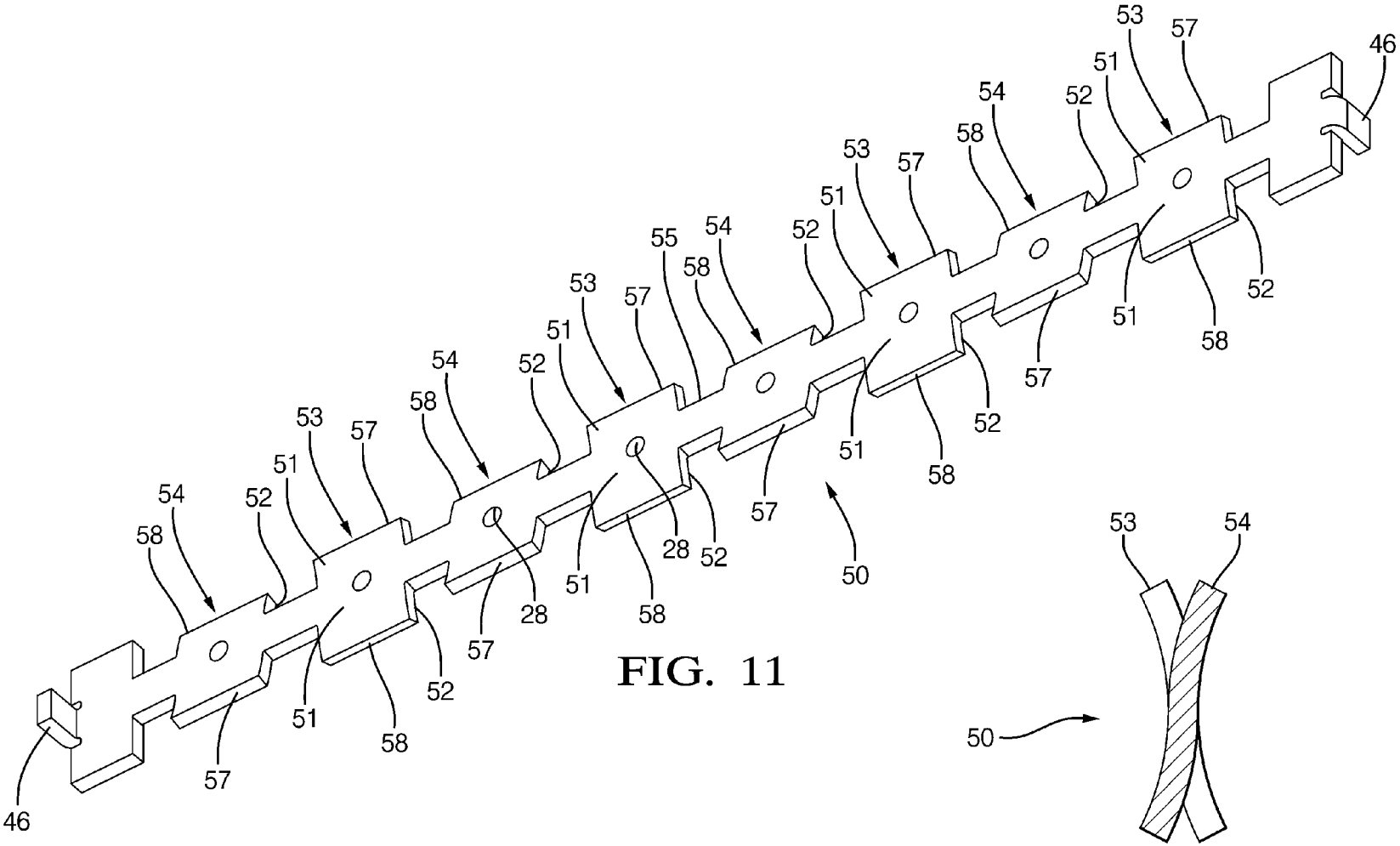
FIG. 11 is a perspective view of the third embodiment of the communication plate.
FIG. 12 is a cross-sectional side view of the third embodiment of the communication plate.

A communication plate 30, 40, 50 extends along and is sandwiched between the communication manifolds 22, and a first embodiment of the communication plate 30 is generally indicated in FIG. 1, FIG. 4, FIG. 5, FIG. 6, and FIG. 7, a second embodiment of the communication plate 40 is generally indicated in FIG. 8 and FIG. 9, and a third embodiment of the communication plate 50 is generally indicated in FIG. 10, FIG. 11, and FIG. 12. Each communication plate 30, 40, 50 includes a plurality of saddling surfaces 31, 32, 41, 42, 51, 52 which include saddling surfaces arcuate in one direction 31, 41, 51 and saddling surfaces arcuate in the opposite direction 32, 42, 52 for engaging in saddle-like fashion the cylindrical shape of the communication manifolds 22. The plurality of saddling surfaces 31, 32, 41, 42, 51, 52 are advantageous because the saddling of the communication manifolds 22 facilitates proper positioning and stabilization of the manifolds 22 during the brazing process. The communication plate 30, 40, 50 defines a plurality of communication plate orifices 28 disposed linearly along the communication plate 30, 40, 50 and co-axial with the communication orifices 26 of the communication manifolds 22 to seal the communication orifices 26 of the manifolds 22 and establish distributed and sealed fluid communication between the first and second heat exchanger assemblies 20, 21. Also, the communication plate allows for further optimization of the fluid communication through variation of the size of the communication plate orifices 28.

In the first embodiment, the communication plate 30 extends continuously and presents the first set of saddling surfaces 31, 32 extending continuously along opposite sides of the communication plate 30 for arcuately engaging each of the communication manifolds 22. The communication plate 30 includes at least one male protrusion 36 extending linearly along each of the first saddling surface arcuate in one direction 31 and the first saddling surface arcuate in the opposite direction 32. The at least one male protrusion 36 is rectangular and has a protrusion length $L_p$ and a protrusion width $W_p$ and a protrusion height $H_p$ measured from the associated first saddling surface 31, 32. Correspondingly, the communication manifolds 22 define a plurality of female notches 38 extending linearly along the manifolds 22 and aligned with the male protrusions 36. The female notches 38 also are rectangular but have a notch length $L_n$ slightly larger than the protrusion length $L_p$ and a notch width $W_n$ slightly larger than the protrusion width $W_p$ and a notch depth $H_n$ slightly larger than the protrusion height $H_p$ for receiving the plurality of male protrusions 36 to align the orifices 26, 28 and stabilize the communication plate 30 during the assembly process.

In the second embodiment, the communication plate 40 is segmented into a plurality of concave plate segments 43, 44 each having a rectangular cross-section and spaced from one another and interconnected by a first center strip 45 with the second set of arcuate saddling surfaces 41, 42 extending radially and in a continuous arc in opposite directions from the center strip 45. The concave plate segments 43, 44 present the second saddling surfaces arcuate in one direction 41 on alternating concave plate segments 43 and the second saddling surfaces arcuate in the opposite direction 42 on concave plate segments which are interleaved 44 with the alternating concave plate segments 43 to present alternating concave plate segments 43 which engage the manifold 22 of the first heat exchanger assembly 20 with the saddling surfaces arcuate in one direction 41 and alternating first plate segments 44 which engage the manifold 22 of the second heat exchanger assembly 21 with the saddling surfaces arcuate in the opposite direction 42. A plurality of tabs 46 extend from the ends of the center strip 45 for engaging the ends of the manifolds 22 to align the orifices 26, 28 and stabilize the communication plate 40 during the assembly process.

In the third embodiment, like the second embodiment, the communication plate 50 is also segmented into a plurality of plate segments 53, 54 each having a rectangular cross-section and spaced from one another and interconnected by a second center strip 55 with the third set of arcuate saddling surfaces 51, 52 extending radially in opposite directions from the center strip 55. In addition, the plate segments 53, 54 present the third saddling surfaces arcuate in one direction 51 on alternating plate segments 53 and the third saddling surfaces arcuate in the opposite direction 52 on plate segments which are interleaved 54 with the alternating plate segments 53.

However, contrary to the second embodiment of the communication plate 40, the communication plate 50 is segmented into a plurality of serpentine plate segments 53, 54 which present the third set of arcuate saddling surfaces 51, 52 extending in first and second oppositely curved arcs 57, 58. As a result, the first curved arcs 57 present the third saddling surfaces arcuate in one direction 51 and the second curved arcs 58 present the third saddling surfaces arcuate in the opposite direction 52 to define a serpentine cross-section in each of the plate segments 53, 54. Further, the alternating serpentine plate segments 53 are arranged in a serpentine cross-section opposite, or a mirror image to, the serpentine cross-section of the interleaved serpentine plate segments 54 to engage the manifold 22 of the first heat exchanger assembly 20 with the first curved arcs 57 and the manifold 22 of the second heat exchanger assembly 21 with the second curved arcs 58. As a result, contrary to the second embodiment of the communication plate 40, the communication plate 50 engages the communication manifolds 22 of the first and second heat exchanger assemblies 20, 21 on opposite sides of each plate segment 53, 54. Like the second embodiment, a plurality of tabs 46 extend from the ends of the second center strip 55 for engaging the ends of the communication manifolds 22 to align the orifices 26, 28 and stabilize the communication plate 50 during the assembly process.

The first heat exchanger assembly 20 includes a second manifold which defines a first outlet manifold 23 extending in spaced and parallel relationship to the first communication manifold 22. A first heat exchanger core 60 is disposed between the first communication manifold 22 and the first outlet manifold 23 for conveying a working fluid from the first communication manifold 22 to the first outlet manifold 23. The second heat exchanger assembly 21 includes a second manifold which defines a second inlet manifold 24 extending in spaced and parallel relationship to the second communication manifold 22. The second inlet manifold 24 is disposed parallel and adjacent the first outlet manifold 23 and the second communication manifold 22 is disposed parallel and adjacent the first communication manifold 22. A second heat exchanger core 62 is disposed between the second inlet manifold 24 and the second communication manifold 22 for conveying a working fluid from the second inlet manifold 24 to the second communication manifold 22.

Each of the cores 60, 62 include a plurality of tubes 64 extending in spaced and parallel relationship to one another between the communication manifolds 22 and each of the second inlet manifold 24 and the first outlet manifold 23. The tubes 64 have a cross section presenting flat sides extending in the transverse direction interconnected by round ends with the flat sides of adjacent tubes 64 spaced from one another by a fin space $S_f$ across the transverse direction. A plurality of air fins 66 are disposed in the fin space $S_f$ between the flat sides of the adjacent tubes 64 and have a cross-section presenting a plurality of legs 68 extending perpendicularly between the flat sides of the adjacent tubes 64 and bases 70 interconnecting alternate ends of adjacent legs 68 and engaging the flat sides of the adjacent tubes 64 to present a serpentine pattern extending between the manifolds 22, 23, 24. The second inlet manifold 24 defines an inlet port 72 for receiving the working fluid and the first outlet manifold 23 defines an outlet port 74 for dispensing the working fluid.

The first and second communication manifolds 22 define the plurality of communication orifices 26 disposed linearly along the communication manifolds 22 and spaced from one another by an orifice space $S_o$, and the communication orifices 26 of the first communication manifold 22 are co-axial with the communication orifices 26 of the second communication manifold 22. The communication plate 30, 40, 50 extends along and is sandwiched between the first and second communication manifolds 22 and defines the plurality of communication plate orifices 28 disposed linearly along the communication plate 30, 40, 50 and spaced from one another by the orifice space $S_o$ and co-axial with the communication orifices 26 of the first communication manifold 22 and the second communication manifold 22 for sealing the communication orifices 26 of the first and second communication manifolds 22 to establish sealed fluid communication between the first heat exchanger assembly 20 and the second heat exchanger assembly 21.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A multi-sectional heat exchanger assembly comprising;

a first heat exchanger assembly and a second heat exchanger assembly, each of said heat exchanger assemblies including at least one communication manifold having a cylindrical shape, said at least one communication manifold of said first heat exchanger assembly being disposed parallel and adjacent to said at least one communication manifold of said second heat exchanger assembly, said communication manifolds defining a plurality of communication orifices disposed linearly along said communication manifolds and wherein said communication orifices of said at least one communication manifold of said first heat exchanger assembly being co-axial with said communication orifices of said at least one communication manifold of said second heat exchanger assembly, and a communication plate extending along and sandwiched between said communication manifolds and defining a plurality of communication plate orifices disposed linearly along said communication plate and being co-axial with said communication orifices of said manifolds for sealing said communication orifices of said at least one manifold of said first heat exchanger assembly and said at least one manifold of said second heat exchanger assembly to establish distributed and sealed fluid communication between said first heat exchanger assembly and said second heat exchanger assembly;

wherein said communication plate defines a plurality of saddling surfaces including saddling surfaces arcuate in one direction and saddling surfaces arcuate in the opposite direction for engaging said cylindrical shapes of said communication manifolds; and wherein said communication plate is segmented into a plurality of plate segments each having a rectangular cross-section and spaced from one another and interconnected by a center strip with said arcuate saddling surfaces extending radially in opposite directions from said center strip.

2. An assembly as set forth in claim 1 further including a plurality of tabs extending from the ends of said center strips for engaging the ends of said communication manifolds to align said orifices and stabilize said communication plate during the assembly process.

* * * * *